US006440185B2

(12) United States Patent
Nagata et al.

(10) Patent No.: US 6,440,185 B2
(45) Date of Patent: Aug. 27, 2002

(54) RESINOID GRINDING WHEEL

(75) Inventors: Akira Nagata, Tsu; Shigeki Nakane, Ichinomiya, both of (JP)

(73) Assignee: Noritake Co., Ltd., Aichi-Ken (JP)

( * ) Notice: Subject to any disclaimer, the term of this patent is extended or adjusted under 35 U.S.C. 154(b) by 0 days.

(21) Appl. No.: 09/755,113

(22) Filed: Jan. 8, 2001

Related U.S. Application Data

(63) Continuation of application No. 09/355,562, filed as application No. PCT/JP98/05312 on Nov. 28, 1998, now abandoned.

(30) Foreign Application Priority Data

Nov. 28, 1997 (JP) ..... 9-344101

(51) Int. Cl.[7] ..... B24D 3/00; B24D 3/02; B24D 3/28; B24D 3/32

(52) U.S. Cl. ..... 51/298; 51/296; 51/307; 51/308; 51/309

(58) Field of Search ..... 51/296, 298, 307, 51/308, 309

(56) References Cited

U.S. PATENT DOCUMENTS

| | | | | |
|---|---|---|---|---|
| 2,806,772 A | | 9/1957 | Robie | 51/296 |
| 3,661,544 A | * | 5/1972 | Whitaker | 51/298 |
| 3,925,034 A | | 12/1975 | Anna et al. | 51/298 |
| 5,110,322 A | * | 5/1992 | Narayanan et al. | 51/298 |
| 5,129,919 A | | 7/1992 | Kalinowski et al. | 51/309 |
| 5,401,284 A | | 3/1995 | Sheldon et al. | 51/309 |
| 5,658,194 A | | 8/1997 | Micheletti | 51/309 |
| 5,713,968 A | | 2/1998 | Fruitman et al. | 51/296 |

FOREIGN PATENT DOCUMENTS

| | | |
|---|---|---|
| EP | 057 392 A2 | 8/1982 |
| JP | 55-137887 | 10/1980 |

* cited by examiner

*Primary Examiner*—Michael Marcheschi
(74) *Attorney, Agent, or Firm*—Morrison & Foerster LLP

(57) ABSTRACT

A resinoid grinding wheel of the present invention has low grinding resistance and is capable of providing a ground workpiece excellent in ground surface quality without burn mark while maintaining essential properties of the resinoid grinding wheel such as low elastic modulus and strong force for holding abrasive grains. A typical resinoid grinding wheel of the present invention includes 25 parts by volume of $Al_2O_3$ abrasive grains with grain size of #150, 20 parts by volume of organic hollow material with average particle diameter of 80 $\mu$m, and 10 parts by volume of pores having 1 mm in size. They are all dispersed in 40 parts by weight of a bond made of cured epoxy resin.

17 Claims, 2 Drawing Sheets

RESINOID GRINDING WHEEL

This application is a continuation of Ser. No. 09/355,562, filed Jul. 28, 1999, now abandoned, which is a 371 application Ser. No. PCT/JP98/05312, filed Nov. 28, 1998.

FIELD OF THE INVENTION

This invention relates to a grinding wheel (generally inclusive of grindstone), more especially to a resinoid grinding wheel, i.e., grinding wheel in which a resinoid bond (resinous bond) is employed.

BACKGROUND ART

A bond used in a grinding wheel generally includes vitrified, resinoid, metal and the like. The resinoid includes resins such as phenol resin, epoxy resin, urethane resin, melamine resin, PVA (polyvinyl alcohol) resin, acrylic resin and the like. These are used depending on workpiece to be ground.

The main reason why the resinoid is used for the bond of a grinding wheel is that it can reduce the load applied on abrasive grains in the course of grinding by its low elastic modulus. By this reason, the resinoid is much used for grinding which requires comparatively high load as compared with other bonds.

Among these resinoid bonds, an epoxy resin is most used especially for grinding with a large stock removal, since its elastic modulus is lower than other resinoid bonds.

THE PROBLEM TO BE SOLVED BY THE INVENTION

However, conventional resinoid grinding wheel has a problem that grinding resistance increases in the course of grinding and grinding burn occurs finally.

In order to solve this problem, there have been proposed such methods for changing the resinoid grinding wheel to have a rough structure by adding thereto an inorganic filler having a very low strength (or hardness) such as talc, mica and the like or inorganic spherical hollow material such as alumina bubble, glass balloon or the like.

However, these methods involve a problem that essential properties of the resinoid grinding wheel become deteriorated by applying these methods. Explaining more in detail, a property of the low elastic modulus that the resinoid grinding wheel essentially has becomes hardly exhibited, and the inorganic filler sometimes prevents grinding. As such, application of the conventional methods raises another problems. As a matter of course, any conventional method has not hitherto provided a perfect solution.

DISCLOSURE OF THE INVENTION

Accordingly, it is an essential object of the present invention to provide a novel resinoid grinding wheel which provides a complete solution to the above described problems that the conventional resinoid grinding wheel has.

In other words, the object of the present invention is directed to provide a resinoid grinding wheel which has low grinding resistance and capable of providing ground materials excellent in ground surface quality without causing grinding burn in the course of grinding while maintaining essential properties of the resinoid grinding wheel such as low elastic modulus and strong force for holding abrasive grains.

Other objects of the present invention will become apparent from the entire disclosure herein.

A resinoid grinding wheel of the present invention includes abrasive grains and filler dispersed in a bond. The filler includes an effective amount of organic hollow material having diameters sufficient for obtaining ground materials excellent in ground surface quality. The bond comprises a cured resin which is produced by curing a liquid resin.

The cured resin can be selected from one or more of cured epoxy resin, cured phenol resin, cured acrylic resin and cured urethane resin.

The average diameter of the organic hollow material may be in a range of 10 to 300 $\mu$m.

The organic hollow material preferably includes one or more of acrylic resins and polyvinylidene chloride-based resins.

The wall thickness of the organic hollow material may be not more than 5 $\mu$m.

The true specific gravity of the organic hollow material may range from 0.01 to 0.1.

The ratio U/B by volume of the organic hollow material U to the bond B may be in a range of 5/100 to 80/100.

The resinoid grinding wheel of the present invention may includes pores as its void in addition to the organic hollow-material. In this case, the ratio K/B by volume of the pores K to the bond B preferably ranges from 5/100 to 350/100.

EXPLANATION OF CODE

1 abrasive grain
2 organic hollow material
3 bond
4 pore

DESCRIPTION OF THE PREFERRED EMBODIMENTS

The summary of the present invention will be explained as follows.

A process for preparing a resinoid grinding wheel includes:

- a press-molding process including the steps of coating mainly powdery raw material of the bond onto abrasive grains, charging the coated abrasive grains into a mold and press-molding the charged material; and
- a casting process including the steps of blending a liquid resin and abrasive grains in a mixer, and casting the blend into a mold in a wet state.

Figure 3:
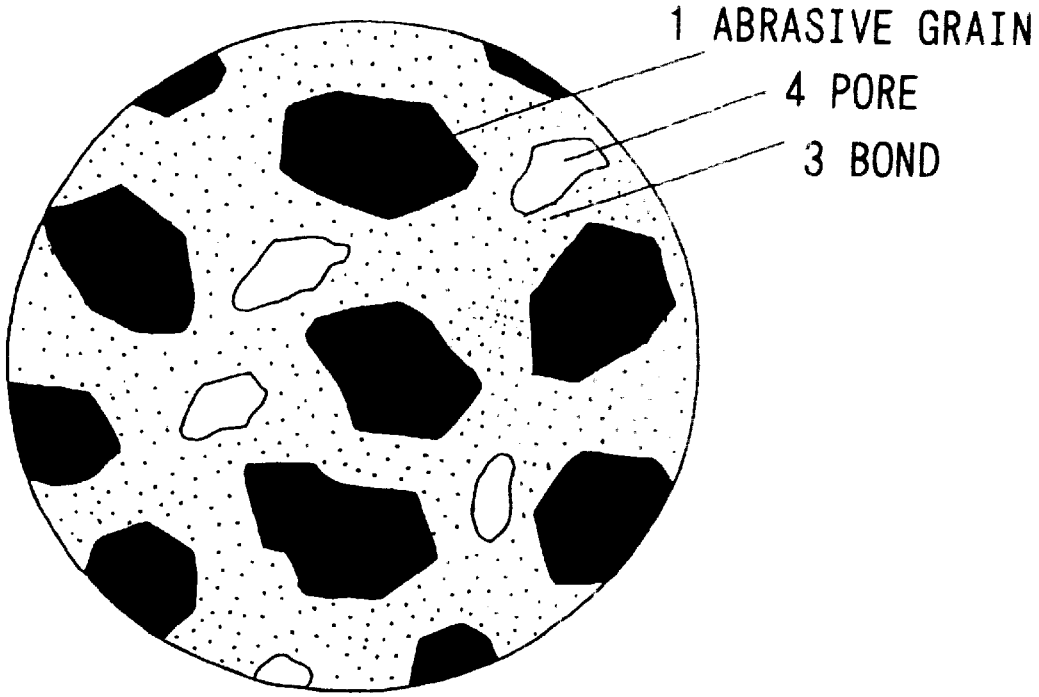
FIG. 3 PRIOR ART
FIG. 3 is an enlarged schematic view partially showing the surface of a conventional resinoid grinding wheel.
Figure 4:
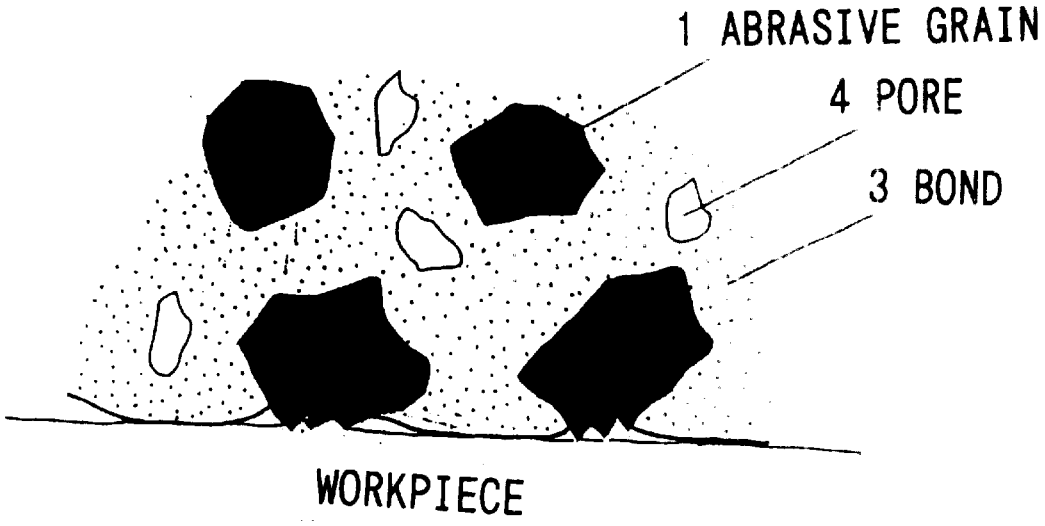
FIG. 4 PRIOR ART
FIG. 4 is an enlarged schematic view showing the cross section of conventional resinoid grinding wheel and ground material in the course of grinding.

The epoxy resinoid grinding wheel can be prepared by the casting process in most cases. The thus prepared resinoid grinding wheel has a structure as illustrated in FIG. 3 that the abrasive grains are hardly in contact with each other and floated in the bond.

In the resinoid grinding wheel prepared from a powder resin, the abrasive grains are partially bonded to each other by a bond bridge. In contrast to this, the whole surface of the abrasive grain is covered with the bond in the resinoid grinding wheel prepared from a liquid resin as illustrated in FIG. 3. As a result, good wetting (or coating state) is produced between the abrasive grain and the bond (curing resin). Thereby, physical contact force (holding force) appears in addition to the chemical adhesive force between the cured resin and the abrasive grain to give a stronger holding force. Accordingly, the resinoid grinding wheel prepared by the casting process makes it possible to maintain the low elastic modulus that the resinoid bond essentially has and to grind with a higher load.

On the other hand, the performance of the resinoid grinding wheel is changed by the ratio of 3 components included therein, that is, the abrasive grain, the bond and pores depending on the kind of material to be ground and grinding conditions. Among them, pores are an important factor for excluding ground powder produced in the course of grinding from the ground surface and widening the distance between the abrasive grains.

In the resinoid grinding wheel obtained by the press molding by using a powder resin, pores each resulting autogenetically based on the filling density (compactness) play the above role. In contrast to this, the amount of pores is small in the resinoid grinding wheel prepared by the casting process, in which pores are only generated by air bubbles entrained into the liquid resin. This is the reason why alumina bubbles (alumina hollow spheres) or foamed styrol each having a size of 0.5 to 3 mm or in some case more than 5 mm in diameter are generally admixed in the course of stirring and casting raw materials including a liquid resin to create newly additional pores.

However, in the resinoid grinding wheel obtained by the casting process using such liquid resin (e.g., epoxy resin), there are many cases that the interspace of the abrasive grains is filled with the bond as illustrated in FIG. 3. In this case, there have been observed many times in the conventional resinoid grinding wheel that the mass of the bond projects from the grinding edges of the abrasive grains. This causes an increase of grinding resistance and grinding burn mark. Namely, the projected mass of the bond prevents grinding because of its low elastic modulus to cause many problems such as the increase of grinding resistance and finally, the grinding burn mark.

In order to reduce the increase of grinding resistance and grinding burn mark, an inorganic filler has been hitherto admixed in the bond. However, this causes an increase in elastic modulus of the bond against all expectations. Further, the filler itself prevents grinding. As such, a complete solution to the problem cannot have been provided.

Figure 1:
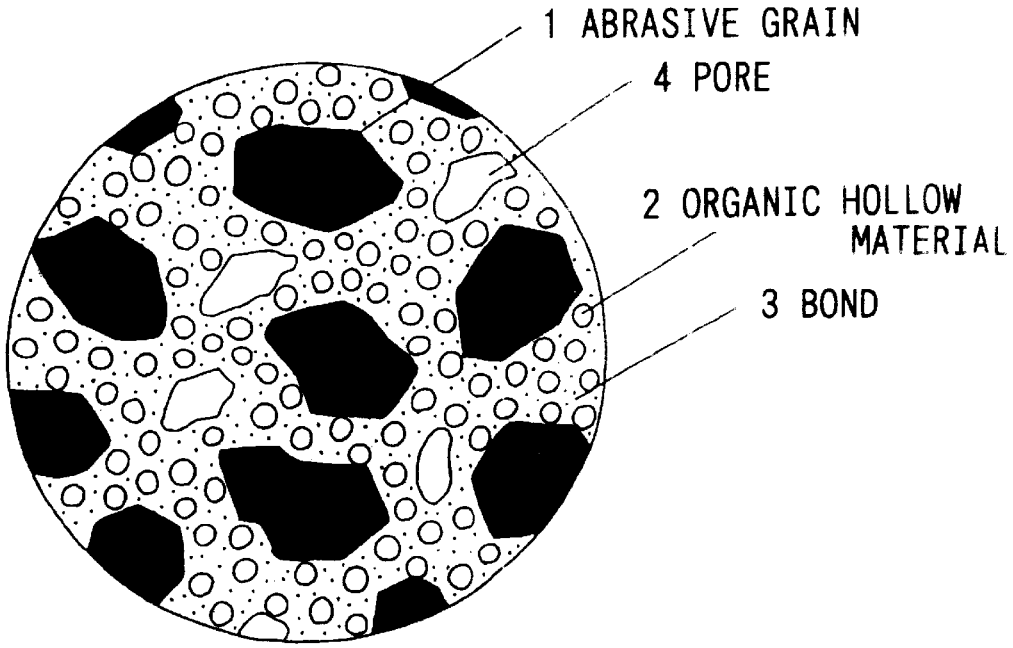
FIG. 1 is an enlarged schematic view partially showing the surface of a resinoid grinding wheel of the present invention.
Figure 2:
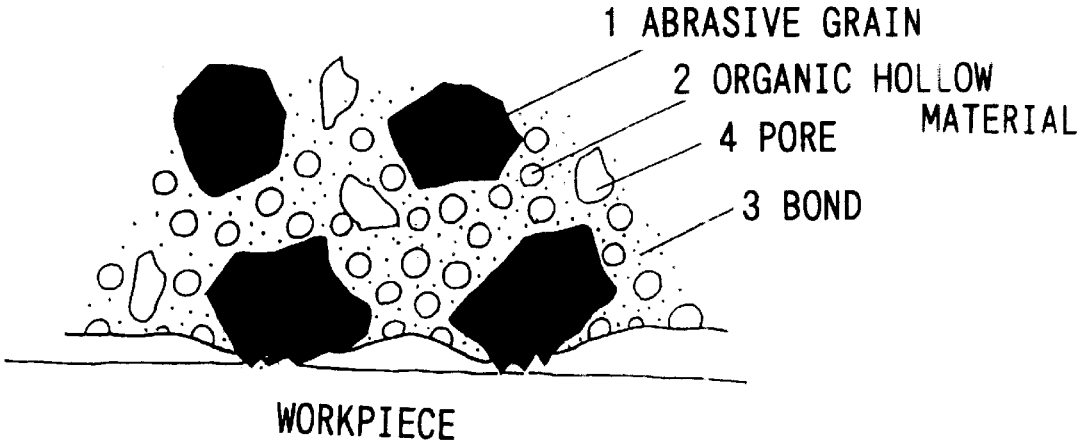
FIG. 2 is an enlarged schematic view showing the cross section of resinoid grinding wheel of the present invention and ground material in the course of grinding.

Under such circumstances, the present inventors tried to add fine organic bubbles (hollow organic spheres) (true specific gravity: 0.01 to 0.1) into the bond and found the following facts. In this result, the bond in the resinoid grinding wheel keeps its low elastic modulus (or apparently lowers the elastic modulus still more) possessed by the resin itself. The projected bond in contact with a face to be ground, even if present, never prevents grinding. Rather, it has an appropriate receding property (that the outermost surface of the bond recedes from the grinding edges of the abrasive grains in contact with a workpiece and thereby be hardly in contact with the workpiece) as shown in FIG. 2. Consequently, the increase of a grinding resistance, which has caused many troubles in the conventional resinoid grinding wheel, is controlled to be little. Finally, the present inventors have completed the present invention.

The numerical range claimed in the appended claims includes not only the limited values disclosed but also all arbitrary intermediate values.

DETAILED DESCRIPTION OF EMBODIMENTS OF THE INVENTION

Resinoid Grinding Wheel

A resinoid grinding wheel of the present invention includes abrasive grains and filler dispersed in a resinoid bond. The filler includes an effective amount of an organic hollow material having diameters sufficient for obtaining a ground material excellent in ground surface quality (preferably sufficient for preventing workpieces from grinding burn mark).

The content of the abrasive grains can be determined depending on the use of the resinoid grinding wheel and etc. The ratio T/B by volume of the abrasive grains V to the bond B preferably ranges from 1/100 to 150/100, more preferably, from 20/100 to 80/100.

Preferable ratio J/B by volume of the filler J including the organic hollow material and optionally inorganic hollow material and the like to the bond B ranges from 5/100 to 400/100. It should be noted that the shrunken pore-forming material of, e.g., foamed styrole included in the resinoid grinding wheel does not count for the filler, although it may be produced by heating and will remain in the resinoid grinding wheel after the production thereof.

The bond is essentially made of cured resin which is produced by curing a liquid resin. The bond preferably includes one or more of cured epoxy resin, cured phenol resin, cured acrylic resin and cured urethane resin. It is more preferable that the bond mainly includes cured epoxy resin. Preferable amount of the cured epoxy resin is not less than 50% by volume, more preferably, not less than 80% by volume. Still more preferably not less than 90%, most preferably, 100% by volume relative to the total volume of the cured resin. The cured resin (cured epoxy resin, cured phenol resin, cured acrylic resin, cured urethane resin etc.) may include powdery inorganic fillers such as powder of quartz, calcium carbonate, various clay minerals such as talc, alumina powder and the like which are distinguished from the resin contained in the raw material of resin and the above filler. The content of the (inorganic) fillers other than the resin may be not more than 30%, preferably, not more than 20% by volume relative to the total amount of the cured resin (inclusive of the fillers other than the resin). Of course, there is a case where no (inorganic) filler other than the resin is allowed to be substantially included in the cured resin.

The content of the organic hollow material included in the resinoid grinding wheel of the present invention may range from 5 to 80% by volume relative to the total amount of the bond (especially in the case that 100% of the bond is made of the cured epoxy resin). More preferable content of the organic hollow material can be determined appropriately depending on grinding conditions and workpiece. In case of producing the resinoid grinding wheel by applying the casting process, when the additional amount of the organic hollow material is more than 80% by volume relative to the bond (especially in the case that 100% of the bond is made of the cured epoxy resin), the viscosity of the intermediate mixture tends to become increased. Accordingly, good products cannot be obtained often. In contrast to this, when the additional amount of the organic hollow material is less than 5% by volume relative to the bond (especially in the case that 100% of the bond is made of the cured epoxy resin), the effect of the organic hollow material tends to be diminished, occasionally resulting in a case of failure of the target desired performance.

The ratio U/B by volume of the organic hollow material U to the bond B is preferably not less than 5/100 and not more than 80/100, more preferably, not less than 5/100 and not more than 50/100, still more preferably, not less than 20/100 and not more than 50/100. The ratio K/B by volume of the pore K (which does not include the pores within the organic hollow material itself) involved in the resinoid grinding wheel of the present invention to the bond B is preferably not less than 5/100 and not more than 350/100, more preferably, not less than 20/100 and not more than 200/100.

Filler

The resinoid grinding wheel of the present invention may include other fillers than the specific organic hollow material together with these organic hollow material.

Organic Hollow Material

The organic hollow material has an organic wall (or shell) and at least one (preferably, one, may be 2 or more) pore covered wholly or partially therewith. The organic wall may preferably be made of resin, especially, synthetic resin. Preferably the pore is closed and does not communicate to the outside.

Preferable material of the organic hollow material is acrylic resin, polyvinylidene chloride resin or mixture thereof.

The term "acrylic resin" is a general term for acrylic polymer and derivatives thereof. The acrylic resin includes polymers or copolymers of acrylic acid, acrylate, acrylamide, acrylonitrile, methacrylic acid and methacrylate etc. Preferably be a copolymer of methacrylic acid and acrylonitrile.

The term "polyvinylidene chloride-based resin" is a general term for a polymer whose polymeric component (preferably, main component) is vinylidene chloride. An exemplary polyvinylidene chloride-based resin is polyvinylidene chloride resin, copolymer of vinylidene chloride and vinyl chloride or the like. Preferably be a polyvinilidene chloride resin.

Preferable mixture of acrylic resin and polyvinylidene chloride-based resin includes a blended resin of methacrylic acid-acrylonitrile copolymer and polyvinylidene chloride. More preferably, 100% of the mixture consists of this blended resin. The mixing amount, by weight, of the polyvinylidene chloride relative to 100 parts of the methacrylic acid-acrylonitrile copolymer is preferably not less than 10 parts, and not more than 1000 parts, more preferably, not less than 30 parts, and not more than 600 parts, still more preferably, not less than 50 parts, and not more than 300 parts, most preferably, not less than 60 parts, and not more than 150 parts.

The thickness of the organic wall (or shell) constituting the organic hollow material is preferably not less than 0.05 μm, and not more than 5 μm, more preferably, not less than 0.1 μm and not more than 0.5 μm, still more preferably, not less than 0.1 μm and not more than 0.3 μm. When the thickness of the wall (or shell) is less than 0.05 μm, the organic hollow material tends to be easily broken in the course of preparing, for example, in stirring raw materials of the organic hollow material, since the resistant strength of the wall is low. Further, such raw materials having these thickness is hardly commercially available. When the thickness of the wall (or shell) exceeds 5 μm, the receding property expected to the organic hollow material of the bond from the surface to be ground tends to be hardly obtained.

The average particle diameter of the organic hollow material is preferably not less than 10 μm and not more than 500 μm, more preferably not less than 10 μm and not more than 300 μm, still more preferably not less than 10 μm and not more than 200 μmm, and most preferably not less than 50 μm and not more than 100 μm. When the particle diameter is less than 10 μm, the effect of the organic hollow material tends not to appear. When the particle diameter exceeds 500 μm, the organic hollow material tends to widen too much the intervals of the abrasive grains in the resinoid grinding wheel. Thereby, abnormal abrasion (wear) and shortening of the grinding period often occur.

The true specific gravity of the organic hollow material is preferably not less than 0.01 and not more than 0.1, more preferably, not less than 0.02 and not more than 0.05.

The pore size of the organic hollow material is preferably not less than 10 μm and not more than 500 μm, more preferably, not less than 10 μm and not more than 300 μm, still more preferably, not less than 10 μm and not more than 200 μm, most preferably, not less than 50 μm and not more than 100 μm.

Preferable form of the organic hollow material is spherical (corresponding to e.g., an organic bubble), approximately spherical, in the form of a rugby ball or the like. The organic hollow material may have other stereo-form such as rectangular parallelepiped, cubic body, round column, prism and the like. Preferable form of the pore included in the organic hollow material is also spherical, approximately spherical, in the form of a rugby ball or the like. The pore may have other stereo-form such as rectangular parallelepiped, cubic body, column, prism and the like. The pore and the organic hollow material preferably have the same form with each other. For example, when the organic hollow material is spherical, preferable pore thereinside is also spherical.

The organic hollow material can be obtained by swelling by heating a heat-expandable microcapsule containing low-boiling hydrocarbon liquid such as isobutane, isopentane or the like. The microcapsule can be prepared by in-site copolymerizing vinylidene chloride, acrylonitrile and the like in the presence of the low-boiling hydrocarbon to encapsulate the low-boiling hydrocarbon liquid with the shell of the thus obtained copolymer. Examples of the microcapsule have diameters of 10 to 30 μm and contain 10 to 15% by weight of the low-boiling hydrocarbon liquid. In heating the microcapsule, the low-boiling hydrocarbon liquid works as an inflating agent to make the microcapsule thermally expansible.

Commercially available organic hollow material can be used in the present invention. It includes EXPANCEL DE (dry expanded) series made by Expancel Co., Ltd. such as 551DE, 551DE20, 551DE80, 461DE, 461DE20, 091DE, 091DE80 and the like; EXPANCEL WE (wet expanded) series such as 551WE, 551WE20, 551WE80 and the like; MATSUMOTO MICROSPHERE F series made by Matsumoto Yushi-Seiyaku Co., Ltd. such as F-20, F-30, F-40, F-50, F-80ED, F-80S, F-82, F-85, F-100 and the like.

Fillers Other Than the Organic Hollow Material

Fillers other than the organic hollow material can be included in the resinoid grinding wheel of the present invention in such amount that adversely affects the resinoid grinding wheel. This amount may be preferably not more than 10% by volume, more preferably, not more than 5% by volume. Fillers other than the organic hollow material include inorganic hollow material, non-hollow fillers, solid particles having substantially no pore which may be made of organic material, inorganic material or composite thereof.

Bond

The resinoid grinding wheel of the present invention includes the bond in an amount by volume of not less than 5% and not more than 80% preferably. More preferable amount is not less than 20% and not more than 60%.

When the resinoid grinding wheel of the present invention includes a bond containing cured epoxy resin, the epoxy resin may be of one or two pack, preferably two-pack epoxy resin curable at ordinary temperatures.

Abrasive Grains

A variety kind of abrasive grains can be used in the present invention. Abrasive grains are classified into two types: one is so called "usual abrasive grains" which includes grains made of $Al_2O_3$, SiC or $ZrO_2$—$Al_2O_3$; the other is so called "super-abrasive grain" made of cubic boron nitride (cBN), diamond or the like which has hardness at least equivalent to that of a diamond. The abrasive grain used in the present invention may be usual abrasive grain, super-abrasive grain or mixture thereof.

Pore

The pores (distinguished from the pore in organic hollow material) included in the resinoid grinding wheel of the present invention may be those of large air bubbles of e.g., 2 to 3 mm or more in diameter self-generated in the course of preparing a resinoid grinding wheel (in the step of e.g., casting) or those of less than 7 mm (for example, not less than 0.5 mm and not more than 1.0 mm or not less than 0.5 mm and not more than 1.5 mm) in diameter formed by the addition of pore-forming agent such as foamed styrol and the like.

Preparation of Resinoid Grinding Wheel

The resinoid grinding wheel of the present invention can be prepared by using liquid resin, preferably, one or more of epoxy, phenol, acrylic and urethane resins. An exemplary process for preparing a resinoid grinding wheel of the present invention by using liquid epoxy resin will be explained below.

The resinoid grinding wheel of the present invention can be prepared by using, for example, two-pack epoxy resin having a main material of liquid epoxy resin and its curing agent. The process for preparing the resinoid grinding wheel includes the steps of mixing the liquid epoxy resin with the organic hollow material, adding the curing agent to the thus obtained mixture, adding then abrasive grains and optionally a pore-forming agent (for example, foamed styrol particles of 0.5 to 2 mm in diameter and the like), and casting the resultant mixture into a predetermined mold. Thereafter, in case of no pore-forming agent being used, a molded article composed of the resultant mixture is allowed to be separated from the mold after curing the resultant mixture at ordinary temperatures, for example, for about 12 hours. In contrast to this, in case of a thermally shrinkable pore-forming agent being used such as the aforementioned foamed styrol particles together with the abrasive grains, the process for preparing the resinoid grinding wheel further includes an after-curing step of heat-treating the thus obtained molded article at about 150° C. to shrink the thermally shrinkable pore-forming agent. Consequently, pores are formed in the resinoid grinding wheel.

The content of the abrasive grains in the molded article can be determined depending on the use of the resinoid grinding wheel and the like. Whether the pore-forming agent is used for preparing the resinoid grinding wheel or not, the ratio T'/B' by volume of the abrasive grains T' to the bond B' ranges preferably from 1/100 to 150/100, more preferably, from 10/100 to 90/100. The ratio J'/B' by volume of the fillers J' (the total of all the fillers which involve the organic hollow material, the pore-forming agent, the inorganic hollow material and the like) to the bond B' in the molded article ranges: preferably from 1/100 to 100/100, more preferably, from 10/100 to 90/100 in case of no pore-forming agent being used; preferably from 1/100 to 400/100, more preferably, 10/100 to 250/100 in case of the pore-forming agent being used.

Whether the pore-forming agent is used for preparing the resinoid grinding wheel or not, the ratio U'/B' by volume of the organic hollow material U' to the bond B' in the molded article ranges preferably from 5/100 to 80/100, more preferably, from 5/100 to 50/100, still more preferably, from 20/100 to 50/100, irrespective of whether or not the pore-forming agent is used.

The volume of the pores (which are self-generated in the course of forming the molded article and distinguished from the organic hollow material) relative to the total volume of the molded article ranges preferably 0 to 40%, more preferably 0 to 15% in case of no pore-forming agent being used; the volume of the self-generated pores and pores generated by the pore-forming agent when used, preferably from 0 to 40%. more preferably, from 0 to 20%.

The ratio K2'/B' by volume of the pore-forming agent K2' such as foamed styrol and the like to the bond B' ranges preferably from 5/100 to 350/100, more preferably, not less than 20/100 and not more than 200/100.

When the pore-forming agent such as the foamed styrol is shrunken by heat in the course of preparing a resinoid grinding wheel, the core of the shrunken pore-forming agent remains inside the pore formed by the same pore-forming agent in the resinoid grinding wheel after the preparation thereof. This core never prevents grinding, since its size is too small.

Now, referring to the epoxy resin applicable to the preparation of a resinoid grinding wheel of the present invention, any liquid epoxy resin is applicable irrespective of whether it is of one- or two-pack type. However, two-pack epoxy resin curable at ordinary temperatures is preferable. This reason is associated with heat resistance of the organic hollow material. In the case that the epoxy resin is curable at temperatures less than the heat resistivity of the organic hollow material, no problem will occur even if the heat-treating temperatures after curing the epoxy resin exceed the heat resistivity of the organic hollow material, since the skeleton of the resinoid grinding wheel has been already established by the cured epoxy resin and the like. From the aspect of widening the space (distance) between the abrasive grains in grinding works, the organic hollow material functions as a large pore-forming agent. Accordingly, similar effects can be obtained even when the resultant resinoid grinding wheel includes foamed styrol or the like as a large pore-forming agent.

In case of preparing the resinoid grinding wheel of the present invention by using two-pack epoxy resin, compounds (curing system) curable at temperatures that never adversely affect the organic hollow material, preferably, those of amine, acid anhydride or the like can be used as for a curing agent of the epoxy resin.

EXAMPLE

Examples of the present invention will be explained below. Preparing conditions and compositions of grinding wheels are as follows.

Formulation of Grinding Wheel

Abrasive grains of $Al_2O_3$ whose grain size are #150 were used. As a bond, two-pack epoxy resin curable at ordinary temperature (main material: modified epoxy resin, curing agent: aromatic amine) was used. Foamed styrol having 1 mm of particle diameter was used as a pore-forming agent. The content of the foamed styrol was controlled so as to obtain the same grinding wheel structure (i.e., the same abrasive grain ratio, the same bond ratio and the same pore ratio) in each of grinding wheels. The conventional grinding wheel having more than 50% by volume of pore ratio failed to be obtained. Large deformation was observed after curing in the course of preparing the grinding wheel by applying the conventional method. Further, fluctuation in the structure was observed due to sinking of the abrasive grains between upper and lower parts of the grinding wheel. Complete pores remained at the portion filled with the foamed styrol after curing compositions of grinding wheels in Examples 1 to 6 and comparative Examples 1 to 5 are shown in Table 1.

TABLE 1

| | Abrasive grain (Parts by vol.) | Resin (Parts by vol.) | Organic bubble (Parts by vol.) | Organic bubble (Av. particle diameter) | Foamed styrol (Parts by vol. ) |
|---|---|---|---|---|---|
| Ex. 1 | 25 | 40 | 2 | 80 μm | 30 |
| Ex. 2 | 25 | 40 | 20 | 80 | 10 |
| Ex. 3 | 25 | 40 | 32 | 80 | 0 |
| Ex. 4 | 25 | 40 | 20 | 10 | 10 |
| Ex. 5 | 25 | 40 | 20 | 50 | 10 |
| Ex. 6 | 25 | 40 | 20 | 150 | 10 |
| Com. Ex. 1 | 25 | 40 | 0 | — | 30 |
| Com. Ex. 2 | 25 | 40 | 1 | 80 | 30 |
| Com. Ex. 3 | 25 | 40 | 34 | 80 | 0 |
| Com. Ex. 4 | 25 | 40 | 20 | 8 | 10 |
| Com. Ex. 5 | 25 | 40 | (Talc 10%) | | 20 |

Examples 1 to 6 and Comparative Examples 1 to 5

Keeping the above grinding wheel formulations (i.e., raw materials and their composition), a main material of the resin was mixed with organic bubbles (organic hollow material) at first. Then, the curing agent of the resin was added to the mixture, followed by admixing the abrasive grains and the foamed styrol. The resultant mixture was put into a predetermined mold. Thereafter, curing was made at ordinary temperatures for 12 hours before separating the molded article from the mold. The molded article was treated by heating at 150° C. after curing. In the above preparing process, the organic bubble made of only acrylic resin having 0.1 μm of wall thickness and 0.04 of true specific gravity was used.

Comparative Examples 1 and 5

The grinding wheel of Comparative Example 1 was the same as that of Example 1 except including no organic bubble. The grinding wheel of Comparative Example 5 was the same as that of Example 1 except including an inorganic filler (talc) in place of the organic bubbles.

Grinding Test

The grinding wheels of a disc (or wheel) having dimensions of 305 mmϕ (outer diameter)×20 mm (thickness)×50.8 mmϕ (inner diameter) were used for grinding test. The test was performed under the following conditions. Namely, a horizontal axis planar grinder was used as for a grinder. Its peripheral speed was 1600 m/min. A workpiece was SS41 (crude material) and had a prism shape of 120 mm (length)× 10 mm (width).

The grinding properties of these grinding wheels were evaluated by power consumption of the grinder required for grinding the workpiece (corresponding to the cutting sharpness of grinding wheel), the wear depth of the grinding wheel and the surface appearance of the ground workpiece. The wear depth and the surface appearance were measured at 100 pass (cycle) of grinding (depth of cut 500 μm). The results are shown in Table 2.

TABLE 2

| Com. Ex. 1 | Power consumption (W) | Abrasion depth (μm) | Appearance of the ground material |
|---|---|---|---|
| Ex. 1 | 510 | 18 | very slight burn |
| Ex. 2 | 420 | 10 | no burn |
| Ex. 3 | 340 | 24 | no burn |
| Ex. 4 | 470 | 14 | no burn |
| Ex. 5 | 440 | 10 | no burn |
| Ex. 6 | 340 | 22 | no burn |
| Com. Ex. 1 | great | — | Burn |
| Com. Ex. 2 | 640 | 27 | Burn |
| Com. Ex. 3 | 290 | 51 | slight burn |
| Com. Ex. 4 | 520 | 25 | Burn |
| Com. Ex. 5 | great | — | Burn |

The effect of the present invention will be summarized as follows.

A resinoid grinding wheel of the present invention as claimed in the first to the last of the appended claims essentially takes the following effects while maintaining essential properties of a resinoid grinding wheel such as low elastic modulus and strong force for holding abrasive grains. Bond receding property (receding property of bond on the grinding surface of grinding wheel) is good, to provide a low grinding resistance. The cutting sharpness of grinding is good. Grinding burn mark hardly occurs. Grinding performance (lifetime of the grinding wheel) can be prolonged significantly. High-load grinding is made possible. These effects closely relate to the following features of the resinoid grinding wheel including abrasive grains and filler dispersed in a bond. The resinoid grinding wheel contains as the filler an effective amount of organic hollow material having diameters enough to obtain a ground material (workpiece) excellent in the ground surface quality. In this addition, the resinoid grinding wheel contains as the bond a cured resin which is produced by curing a liquid resin.

Any constituent feature recited in the second to the last of the appended claims will assist in exerting the above essential effects more exactly.

The present invention involves any modification derived from matters disclosed herein such as embodiments and examples of the present invention as well as the appended claims by any procedure including combination of the disclosed matters or elements, selection or deletion from the same. The examples and the embodiments as illustrated in any figure of the accompanying drawings are therefore to be considered in all respects as illustrative and not restrictive. In other words, any modification which comes within the meaning and range of equivalency of the claims is therefore intended to be embraced in the scope of the present invention.

What is claimed is:

1. A resinoid grinding wheel comprising abrasive grains, particles of an organic hollow material and a pore-forming agent dispersed in a resinoid bond, the organic hollow material particles having an average diameter in a range of not less than 10 μm and not more than 300 μm, said resinoid bond being made of a cured resin which is produced by curing at least one liquid resin selected from the group consisting of epoxy resin, acrylic resin and urethane resin, wherein a ratio U/B by volume of the organic hollow particles U to the resinoid bond B is not less than 5/100 and not more than 80,100, wherein particles of said organic hollow material particles are discretely dispersed in and fully surrounds by the resinoid bond and wherein the abrasive grains, except for those dispersed on a surface of the grinding wheel, are fully surrounded by the resinoid bond.

2. The resinoid grinding wheel as defined in claim 1, wherein said organic hollow material particles have a wall thickness not less than 0.05 μm and not more than 5 μm.

3. The resinoid grinding wheel as defined in claim 1, wherein said organic hollow has an average diameter in a range of not less than 10 μm and not more than 150 μm.

4. The resinoid grinding wheel as defined in claim 1, wherein said organic hollow material is made of a substance selected from the group consisting of an acrylic resin and a polyvinlidene chloride-based resin.

5. A resinoid grinding wheel comprising abrasive grains and filler dispersed in a resinoid bond, the filler comprising an amount of organic hollow material having an average diameter in a range of not less than 10 μm and not more than 300 μm, said bond being made of a cured resin which is produced by curing at least one liquid resin selected from the group consisting of epoxy resin, acrylic resin and cured urethane resin, wherein the ratio U/B by volume of the organic hollow material U to the bond B is not less than 5/100 and not more than 80/100, wherein said abrasive grains, except for those dispersed on a surface of the grinding wheel, are fully surrounded by the resinoid bond having therein said organic hollow material in the form of dispersed discrete bubbles, said organic hollow material providing a receding property to the bond on a grinding surface of the grinding wheel, wherein said organic hollow material is made of a substance selected from the group consisting of an acrylic resin and a polyvinylidene chloride-based resin.

6. The resinoid grinding wheel as defined in claim 1, wherein said organic hollow material comprises acrylic resin and said liquid is an epoxy resin.

7. The resinoid grinding wheel as defined in claim 1, wherein said organic hollow material has a wall thickness of not more than 5 μm.

8. The resinoid grinding wheel as defined in claim 1, wherein said organic hollow material has a true specific gravity of not less than 0.01 and not more than 0.1.

9. The resinoid grinding wheel as defined in claim 8, wherein the ratio U/B by volume of the organic hollow material particles U to the bond B is not less than 20/100 and not more than 50/100.

10. The resinoid grinding wheel as defined in claim 8, which further comprises pores other than said organic hollow material, wherein the ratio K/B by the volume of said pores K to said bond B ranges from the 5/100 to 350/100.

11. The resinoid grinding wheel as defined in claim 1, which further comprises pores other than said organic hollow material, wherein the ratio K/B by volume of said pores K to said bond B ranges from 5/100 to 350/100.

12. The resinoid grinding wheel as defined in claim 9, which further comprises pores other than said organic hollow material, wherein the ratio K/B by volume of said pores K to said bond B ranges from 5/100 to 350/100.

13. The resinoid grinding wheel as defined in claim 1, wherein the ratio U/B by volume of the organic hollow material U to the bond B is not less than 5/100 and not more than 50/100.

14. The resinoid grinding wheel as defined in claim 1, wherein the ratio U/B by volume of the organic hollow material U to the bond B is not less than 20/100 and not more than 50/100.

15. The resinoid grinding wheel as defined in claim 1, which further comprises pores other than said organic hollow material, wherein the ratio K/B by volume of said pores K to said bond B ranges from 20/100 to 200/100.

16. A method for manufacturing a resinoid grinding wheel, comprising:

mixing liquid resin with particles of an organic hollow material to form a first mixture to discretely disperse the organic hollow material particles in the liquid resin, adding a curing agent to the first mixture to form a second mixture, adding a pore-forming agent to the second mixture, and adding abrasive grains to the second mixture, wherein the resinoid grinding wheel comprising the abrasive grains, the organic hollow material particles and the pore-forming agent dispersed in a resinoid bond, the organic hollow material having an average diameter in a range of not less than 10 μm and not more than 300 μm, said resinoid bond being made of a cured resin which is produced by curing at least one liquid resin selected from the group consisting of epoxy resin, acrylic resin and urethane resin, wherein particles of said organic hollow particles are discretely in and fully surrounded by the resinoid bond and wherein the abrasive grains, except for those dispersed on a surface of the grinding wheel, are fully surrounded by the resinoid bond.

17. The method of claim 16, wherein a ratio U/B by volume of the organic hollow material U to the resinoid bond B is not less than 5/100 and not more than 80/100.

* * * * *